US006763637B2

(12) United States Patent
Pelosi, Jr.

(10) Patent No.: US 6,763,637 B2
(45) Date of Patent: Jul. 20, 2004

(54) TRANSITION SUPPORT FOR FLOORING MATERIAL

(75) Inventor: Frank Pelosi, Jr., Moorestown, NJ (US)

(73) Assignee: Duramax, Inc., Middlefield, OH (US)

( * ) Notice: Subject to any disclaimer, the term of this patent is extended or adjusted under 35 U.S.C. 154(b) by 81 days.

(21) Appl. No.: 10/141,304

(22) Filed: May 8, 2002

(65) Prior Publication Data

US 2002/0129452 A1 Sep. 19, 2002

Related U.S. Application Data

(63) Continuation-in-part of application No. 08/801,010, filed on Feb. 19, 1997, now Pat. No. 6,385,923.

(51) Int. Cl.[7] ..... E04F 11/16

(52) U.S. Cl. ..... 52/181; 52/273; 52/287.1; 52/717.1; 52/717.03; 52/717.05; 16/717.1; 16/17; 248/188.3

(58) Field of Search ..... 52/177, 179, 181, 52/287.1, 716.1, 717.03, 717.05, 273; 16/7, 17.1; 248/188.2, 188.3

(56) References Cited

U.S. PATENT DOCUMENTS

| | | | | | |
|---|---|---|---|---|---|
| 4,187,656 | A | * | 2/1980 | Lutz | 52/273 |
| 4,526,641 | A | * | 7/1985 | Schriever et al. | 156/247 |
| 5,243,798 | A | | 9/1993 | Elliott | |
| 5,475,953 | A | | 12/1995 | Greenfield | |
| 5,581,967 | A | * | 12/1996 | Glatz | 52/465 |
| 5,657,598 | A | | 8/1997 | Wilbs et al. | |
| 6,062,517 | A | * | 5/2000 | Torres et al. | 248/188.2 |
| 6,230,446 | B1 | * | 5/2001 | Chalich | 52/98 |
| 6,385,923 | B1 | * | 5/2002 | Pelosi, Jr. | 52/179 |

* cited by examiner

*Primary Examiner*—Carl D. Friedman
*Assistant Examiner*—Yvonne M. Horton
(74) *Attorney, Agent, or Firm*—D. Peter Hochberg; Sean Mellino; Katherine R. Vieyra

(57) ABSTRACT

A transition support for flooring material extending between a floor area of a high height and a floor area of a low height, said support being in the shape of a wedge with an attached flat section in the shape of a rectangular parallelepiped, the wedge having a thick end whose thickness is the same as that of the flat section. The transition support is generally unnoticeable by persons walking across it and does not jostle wheeled vehicles crossing the support.

35 Claims, 5 Drawing Sheets

TRANSITION SUPPORT FOR FLOORING MATERIAL

CROSS REFERENCE TO RELATED APPLICATION

This application is a continuation-in-part of application Ser. No. 08/801,010 filed on Feb. 19, 1997, now U.S. Pat. No. 6,385,923 issued May 14, 2002.

BACKGROUND OF THE INVENTION

1. Field of the Invention

This invention relates to supporting flooring materials extending on adjacent underlying flooring of different heights and spanning the transition between the adjacent flooring and including a platform or tack strip so that the junction of the materials can be in a separate vertical plane from the juncture of the underlying flooring, making the transition generally unnoticeable to people walking on flooring over the juncture or to wheeled vehicles which will not be jostled or upset when crossing the transition at the juncture.

2. Description of the Prior Art

In many institutions such as factories, exhibitions halls, shopping malls, transportation facilities and the like, floors of hard materials such as tile, marble granite, brick, quarry stone or ceramic are frequently adjacent to floors of concrete or wood. The adjacent floors usually meet at a juncture, and there is an interface or juncture between the floor area of the relatively high height and the floor area of the relatively low height. Transition flooring is often put over all of the floor areas to make it easier and safer to walk across the floor areas and the juncture, and to make it easier for wheeled vehicles to traverse the juncture of the floor areas. It is common to ramp up to the higher floor area.

However the transition flooring, which can be a flexible vinyl or rubber based sheet, or flexible vinyl or rubber based tiles or a carpet material, or a hardened resilient material, such as vinyl composition or hard rubber tiles, must extend from the juncture onto the floor area of the relatively low height. If no transition support is provided, there could be a sharp incline in the flooring at the juncture. People could trip or at least be surprised and jarred when they step on the flooring at the juncture, especially if they are unaware that the difference in heights exists. In addition, wheeled vehicles could be jostled, tipped or possibly overturned if they reach an unexpected abrupt change in the height of the flooring. Moreover, the transition flooring could become frayed, cracked or torn over time, especially if the juncture is in an area of high traffic.

In most instances in commercial buildings where the sharp transition between floor materials of different heights is made more gradual, a worker uses a trowel to lay by hand cementitious material, such as a latex underlayment, at the juncture between the high and low flooring levels. This is time consuming and expensive, and the time to lay the material depends on the ability and skill of the troweler. Once the troweler has laid the cementitious material, he or she uses adhesive to connect the flooring material to the cementitious material. In other cases, workers stack old tile to reduce the steepness of the juncture between the adjacent flooring areas.

The difference in height between the two areas of the floor as discussed above is generally not great, often around ¼ inch, so the problem has not been previously and seriously addressed. Architects have no standard for addressing the problem. Compensating for the difference in heights between adjacent flooring areas is a real problem.

There are various patents which have been issued relating to the support of carpets near walls, including U.S. Pat. No. 530,096 (Eckman 1894), U.S. Pat. No. 1,070,273 (MacLean 1913), U.S. Pat. No. 1,401,490 (Rathjens 1921), U.S. Pat. No. 1,483,941 (Kasson 1924), U.S. Pat. No. 1,833,732 (Barrows 1931), U.S. Pat. No. 1,988,603 (McLaren et al. 1935), U.S. Pat. No. 2,677,145 (Adams 1954), U.S. Pat. No. 3,086,262 (Krantz 1963), and U.S. Pat. No. 4,187,656 (Lutz 1980).

However, the foregoing patents are not directed to the support of flooring at or near the juncture between adjacent floor areas of different heights. U.S. Pat. No. 1,128,061 (Schroeter 1915) is directed to metal edge binding in linoleum. Which is also not a problem to which the present invention relates. Rather, Schroeter provides an edge binding which securely holds the floor covering in place and protects the edge of same. Schroeter wants to protect the flooring against, for example, breakage or wear by shoes or truck wheels, but Schroeter is not concerned with people or vehicles crossing the floor. U.S. Pat. No. 5,475,953 (Greenfield 1995) relates to an edge molding strip for protecting the floor covering between first and second floors of different heights, but it relates to the objects of the present invention in only a very general way. U.S. Pat. No. 5,243,798 provides a wedge shaped finishing member for draining water away from a bathtub, and it too is not directed to the problems to which the invention is directed.

U.S. Pat. No. 2,142,832 (Bell 1939) discloses a mat construction made of a multiplicity of rubber blocks arranged in an overlapping, laterally abutting relationship. The mat has a nosing strip running along its edge. Bell does not recognized recognize the problem of providing a transition between two levels of flooring.

U.S. patent application Ser. No. 08/801,010, from which this application derives, discloses a gradual ramp or wedge which supports flooring at the juncture of materials of different heights at the transition at the juncture between materials, so that the transition is generally unnoticeable to people walking on flooring over the juncture or where wheeled vehicles will not be jostled or upset when crossing the transition at the juncture. However, the device in this prior application is entirely ramped; no flat surface is provided. Thus the device must abut the higher flooring and the flooring height must begin to change at this juncture.

SUMMARY OF THE INVENTION

The present invention solves the problem of the prior art by providing a gradual ramp along with a narrow platform and sometimes a carpet tack strip to transition between two different flooring elevations. Unlike prior methods this invention creates a smooth transition without costly labor and curing time, enhancing both the visual aesthetics and life-safety characteristics of flooring. The floorings supported by the invention do not necessarily join where the floor changes height; instead, one flooring can extend over the juncture of the floor heights and meet the other on a level surface. Significantly reducing the fraying, cracking and tearing of the floorings at the juncture. Further, the flooring height need not begin to decrease where the invention abuts the existing flooring support. The platform found in the invention is a continuation of the wedge but flat across the top. The carpet tack strip, which adheres to the platform, is comprised of numerous carpet pins set typically at an angle of about 60 degrees and extending from the surface of the tack strip a distance of advantageously 7/32". In addition to the carpet pins, the tack strip typically has 5/8" concrete nails or 1" wood floor nails equally spaced across the tack strip length to secure the tack strip to the platform.

It is an object of the present invention to provide a support for flooring covering floor areas of different heights where the floorings can join in separate vertical plane from the juncture of the sections of the floor.

Another object of the invention is to provide a support for flooring, such as those having vinyl or rubber components or those made of carpeting, which cover the juncture of floor areas made of different materials and have different heights, such that the juncture of the floorings is not vertically above the juncture of the floor areas, and the carpet or rubber components can be tacked on to the support at the tack strip to reduce wear and tear at the juncture of the floorings.

A further object of the present invention is to provide a transition support for flexible sheet flooring at the juncture of floors made of ceramic or tile, and floors made of concrete or wood where there is a difference in heights between the two sections of the floor, such that the juncture of the flooring may not be vertically above the juncture of the floor areas.

Yet another object of the invention is to provide a transition support for flooring as described above, which is generally unnoticeable to a person walking across the support or which does not jostle wheeled vehicles crossing the support.

An additional object is to provide a transition support for flooring areas of different heights which can be installed by workers who need not be highly skilled in laying transition supports.

A still further object of the invention is to provide a transition support as described above which can be made in large economical quantities, and which can be installed quickly, economically and effectively, in large institutional buildings such as schools and hospitals, office buildings, factories shopping malls and other stores, exhibition halls, transportation facilities and the like.

According to the preferred embodiment of the invention, a transition support (which is also called a patch board or a leveler strip) has a generally wedge shaped construction with a rectangular parallelepiped extension, i.e. a generally solid rectangular strip or platform, integral with and attached to the thick end of the wedge. That is a transition support according to the preferred embodiment of the invention comprises a wedge with an integral flat section in the form of a rectangular parallelepiped, the wedge having a thick end with a thickness which is also the thickness of the flat section. The transition support has a bottom surface for engaging the flooring and a top surface forming means for supporting flooring material. The transition support is for use with a pair of adjacent floors. One having a higher level than the other, such as because of different heights of the underlying floor or because of a flooring material such as tiles or sheet flooring on one of the floors (or a part of a floor). The two floors meet at a juncture, and the juncture has a height. If there is flooring material on one or both of the adjacent floors, the height of the juncture is adjusted accordingly so that the flooring material on the flat section is flush with the flooring material on the high area of the adjacent floors.

As explained above, the juncture of the flooring material on the adjacent floors can be the same as or different from the juncture of the flooring material on the adjacent floors. If one adjacent floor is at a higher level than the other floor, the flooring material could either extend from the high level over the lower level, in which case the transition support would have a thick end sufficient for the flooring material it supports to meet the flooring material on the flat section of the support at the same level to render both junctures unnoticeable to persons passing over them or to reduce or prevent jostling of wheeled vehicles crossing them. The flooring material on the upper level could terminate shy of the juncture with the adjacent floor, and the transition support could support flooring material which extends beyond the top surfaces of the inclined part or wedge and the flat section, and meet the flooring material on the upper level with the top of the flooring materials being flush to render them unnoticeable, and reduce or prevent jostling as explained above. The juncture of the adjacent floors could be located in the same vertical plane as the juncture of the flooring materials in which the thickness of the thick end of the transition support should render the top surface of the two flooring materials to be flush to render the junctures unnoticeable and to reduce or prevent jostling of wheeled vehicles as discussed above and elsewhere. In order to assist in firmly securing the flooring material to the flat section, a tack strip can be fastened to the flat strip such as by nails or the like extending through the flat strip into the underlying floor, and tacks can project upwardly from the tack strip to extend into the flooring material and hold it in place as is normally done with tack strips. The transition support is made of a flexible plastic such as vinyl and has a thick end portion, a parallel thin end portion, a flat section which extends from the upper portion of the thick end to a flat center portion, and a tapering section which extends from the flat center portion to the thin end. Alternatively, the transition support can be a hard material such as vinyl composition or hard rubber tiles. (The sections will be described as if the transition support is in place, with an upper section and a lower section). The transition support has a bottom surface for resting on a floor and a top surface for supporting flooring material such as carpet, tiles, sheet flooring or other flooring material. The flooring material meets other flooring material on an adjacent floor at a higher level. The contour of the tapering section is very slight, so that walkers crossing the transition support, especially when it is covered with a flooring, will not be aware of its presence. Likewise, carts, motor driven carriers, dollies, wheeled stretchers, wheeled carrying cases, and other wheeled vehicles will not be jostled or upset when they cross the transition support for the flooring supported thereby.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
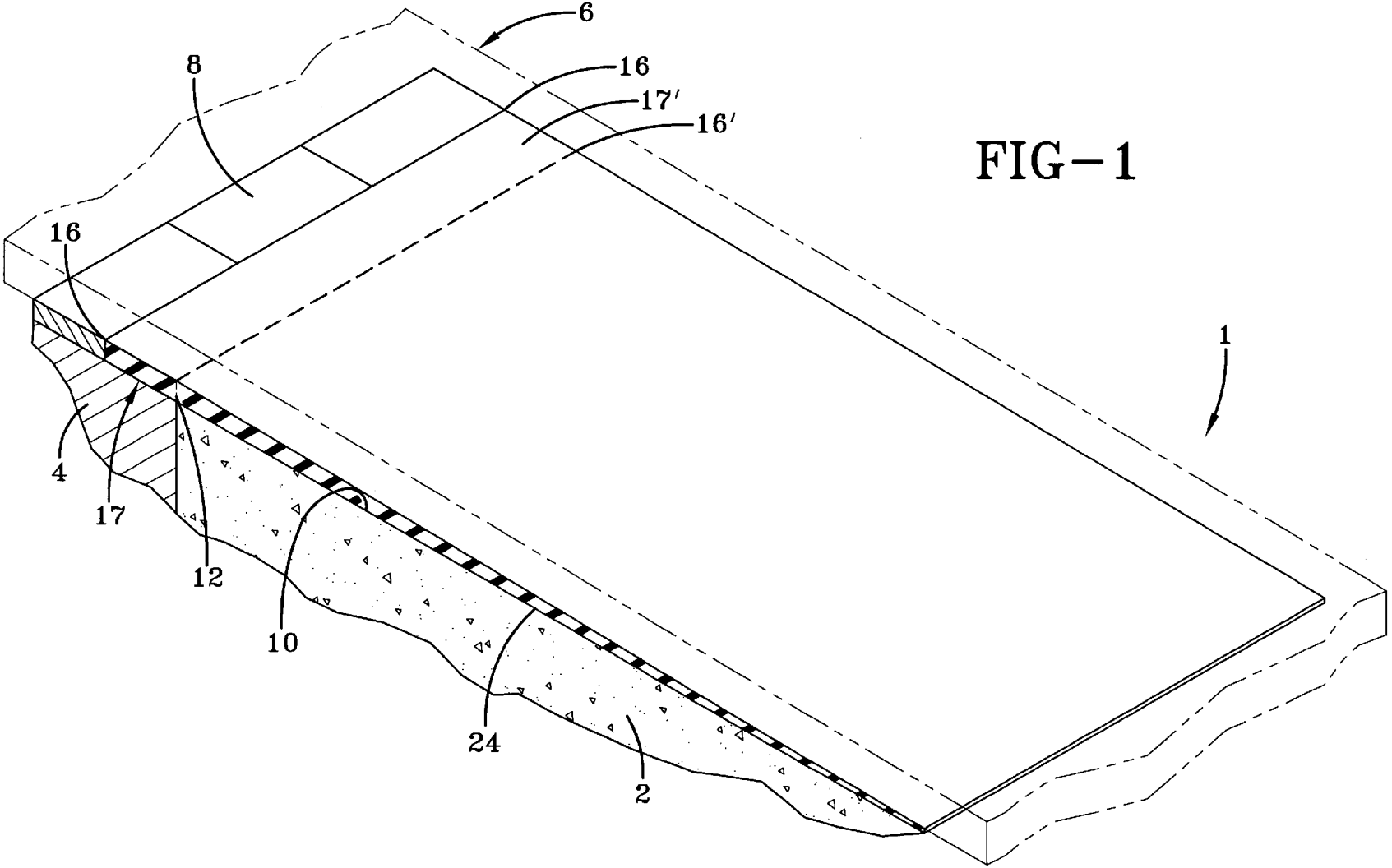
FIG. 1 is a perspective view of the transition support according to the preferred embodiment of the invention, installed for supporting a flexible sheet flooring.
Figure 1A:
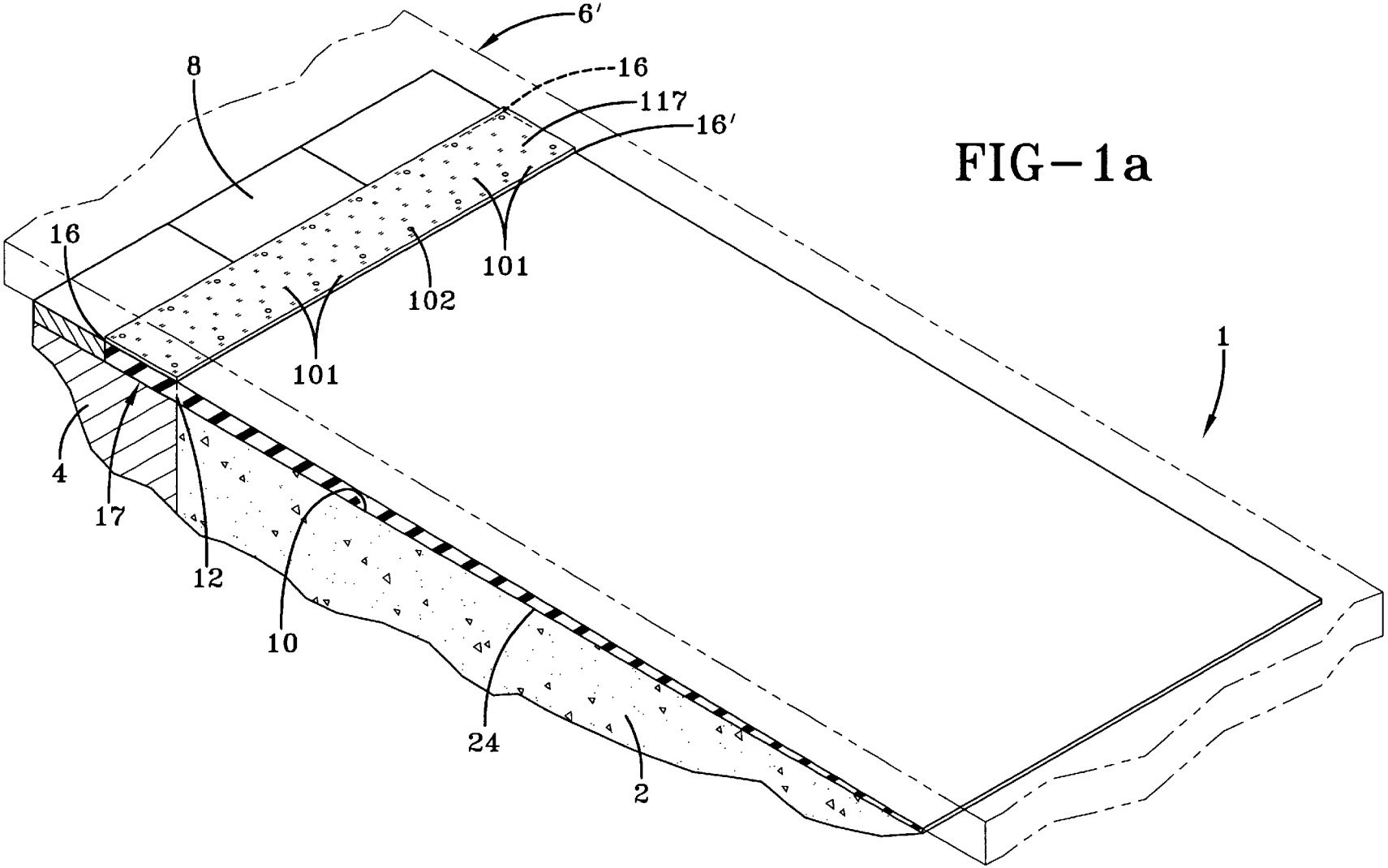
FIG. 1*a* is a perspective view of the transition support according to the second embodiment of the invention which includes a tack strip, installed for supporting a flexible sheet flooring.

Referring now to the drawings wherein the showings are for the purpose of illustrating the preferred embodiment of the invention only, and not for the purpose of limiting same, FIG. 1 shows a transition support 1 in perspective. It is located on a concrete floor 2 which is adjacent to another floor 4. A set of tiles 6 are is located on floor 4. Tiles 6 could be of vinyl, rubber, ceramic or any other composition. Tiles 6 could be replaced by any other type of floor, such as carpet 6' shown in phantom in FIG. 1*a* provided for the present discussion that their top surface 8 is above or below the top surface 10 of floor 2. Tiles 6 and carpet 6' are shown above floor 2. A juncture 12 exists between flooring 2 and the flooring 4, and another juncture 12' exists between flooring 4 and tiles 6.

A flexible sheet flooring 14 shown in phantom lines, lies on floor 2, on transition support 1 and on tiles 6. Flooring 14 could be harder, and less flexible or inflexible. In the alternative flooring 14 could be carpeting. Transition support 1 rests on flooring 2, and support 1 has a thick end 16 and a thin end 18. Thick end 16 is generally equal to the difference in height between the lower floor area (area 2 in the present example), and the higher floor area (area 4 and tile 6 in the present example). For this discussion, the heights of floor 2 and floor 4 are the same (and they could be the same floor), so thick end 16 is shown equal to the thickness of tiles 6. The thickness of thick end 16 need not exactly equal the difference in height between the two adjacent floor areas, since support 1 can be flexible and resilient, so the transition between the heights will not be noticeable.

Figure 2:
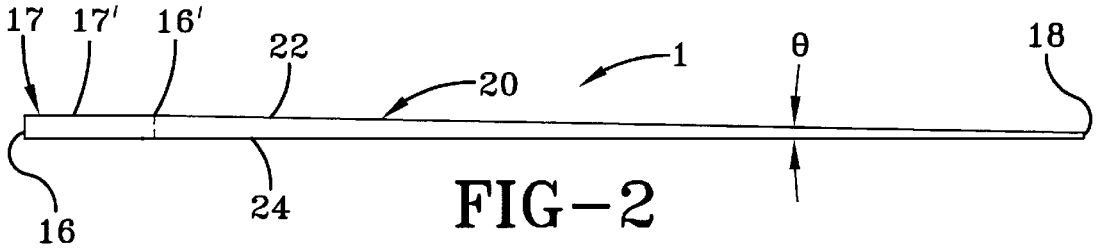
FIG. 2 is a side view of the transition support shown in FIG. 1.
Figure 3:
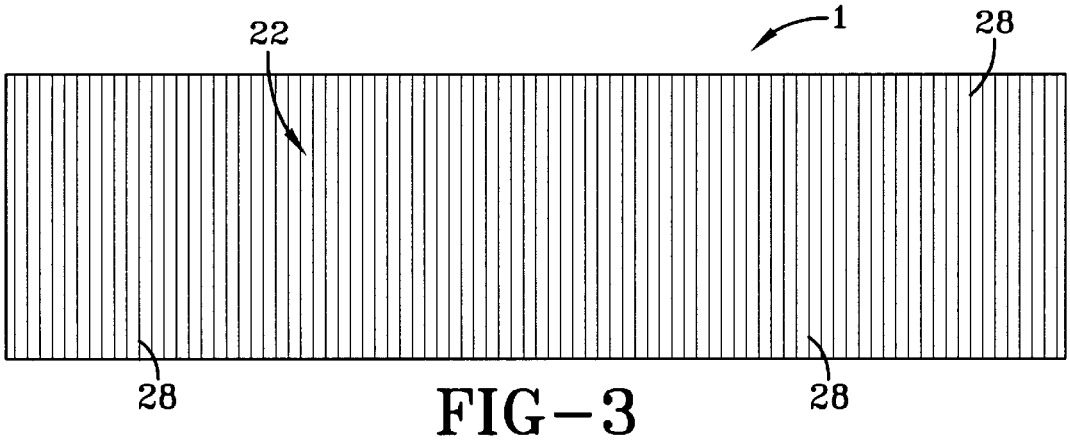
FIG. 3 is a plan view of the transition support shown in FIG. 1.
Figure 4:
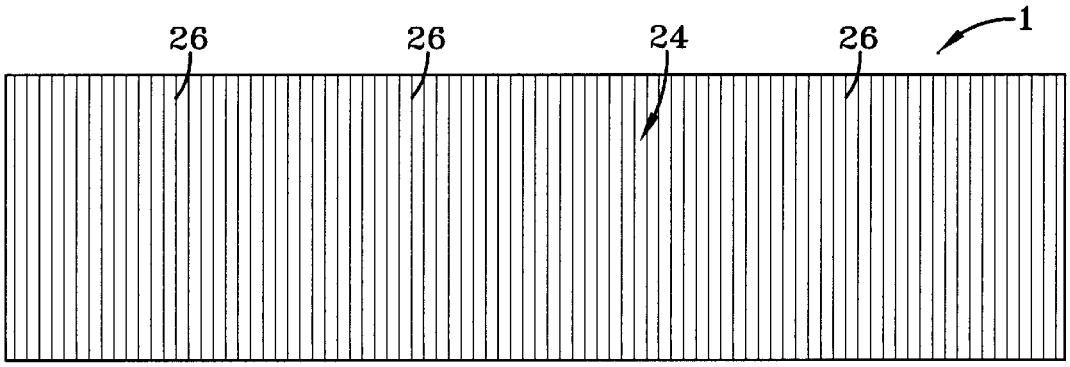
FIG. 4 is a bottom view of the transition support shown in FIG. 1.

Transition support 1 has a flat section 17 which is a solid platform or a rectangular parallelepiped extending between thick end 16 and strip end 16', and a tapering section or wedge 20 extending between strip end 16' and thin end 18. Flat section 17 has a top surface 17' and a bottom surface 24. Tapering section 20 has a top surface 22 and the uninterrupted continuation of bottom surface 24, as shown in FIGS. 2–4. There is thus a tap surface 23 extending across wedge 20 and flat section 17. The tapering surface 22 should be of sufficient distance between thick end 16' and thin end 18 so that one crossing support 1 on foot or with a wheeled vehicle would not notice transition support 1, or the vehicle would not be jostled or upset. Thus, the distance from thin end to the thick end is at most variations at least thirty (30) times the height of the thick end. In the preferred embodiment, thick section 16 was ¼ inch thick and thin end 18 was disposed 12 inches from strip end 16' and the interior angle between top surface 22 and bottom surface 24 was 3°. The thickness of the flat section 17 generally should not exceed 3/16 inches. However, in some situations, the thickness of the flat section 17 as well as the thick end 16 could be increased to ½ inch or even ¾ inch.

Figure 1B:
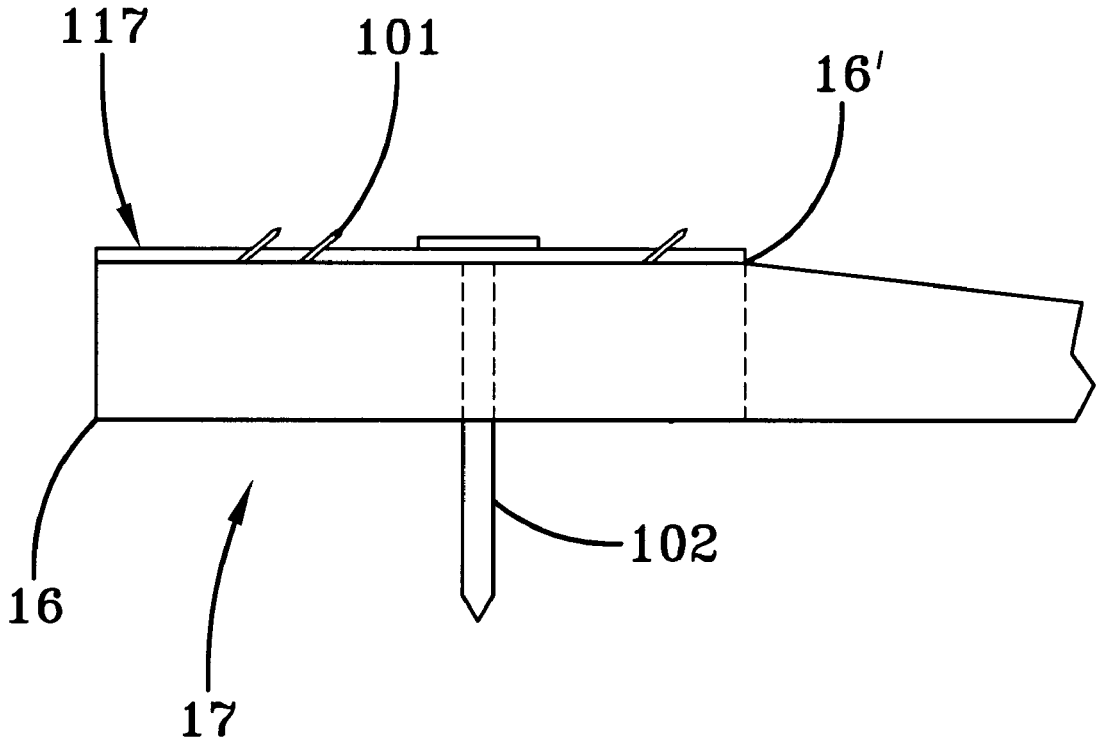
FIG. 1*b* is a detailed vie v of the carpet tack strip shown in FIG. 1*a*.

In a second embodiment as shown in FIG. 1*a*, transition support 1 also contains a carpet tack strip 117, shown in phantom in FIG. 1*a* and clearly in FIG. 2, attached to the flat section 17. The carpet tack strip is comprised of numerous carpet pins 101 set typically at an angle of about 60 degrees and extending from the surface of the tack strip a distance of advantageously 7/32" carpet pins 101 are more dense than shown in FIGS. 1*a* and 1*b*. In addition to the carpet pins 101, the tack strip 117 typically has ⅝" concrete nails 102 or 1 "wood floor nails (not shown) equally spaced across the tack strip length to secure the tack strip to the flat section and also to the floor 2. Carpeting 118 is shown in tack strip 17.

In a third embodiment, thick section 16 was ⅛ inch thick and thin end 18 was disposed 12 inches from strip end 16'. In a fourth embodiment, thick section 16 was ⅜ inch thick and thin end 18 was disposed 12 inches from strip end 16'. In a fifth embodiment, thick section 16 was ½ inch thick and thin end 18 was disposed 12 inches from strip end 16'. In this, the distance from the thin end to the thick end is twenty four (24) times the height of the thick end. In a sixth embodiment, thick section 16 was ¾ inch thick and thin end 18 was disposed 12 inches from strip end 16'. The ratio of the latter distance to the height of the thick end is nine (9). Each of these embodiments three through six can also include the carpet tack strip 117 attached to the flat section 17.

The maximum angle for other preferred versions of the invention should not exceed 10°, and the minimum angle should be less than 1°. The width, or distance between the strip end 16' and the thin end 18, should generally be between 10 inches and 20 inches. The distance between the strip end 16' and the thin end should be at least 30 times the thickness of the thick end until the thickness is about ½ inch. Scoring lines can be placed on top surface 22 so that the transition support can be cut to create specific heights for non-conforming projects.

In order to secure support 1 on a floor such as floor 2 an appropriate adhesive can be used. In order to promote the strength of the adhesive, slight ridges 26 or other physical changes in bottom surface 24 are provided to hold the adhesive as well as to improve the friction between support 1 and the floor. Likewise, ridges 28 are provided on the top surface of support 1. An effective set of ridges has been found to be about 10 ridges per inch and to be less than 0.1 mm in height. Flooring 14 is preferably secured to support 1 with an appropriate adhesive, and ridges 28 both hold the adhesive in place and increase friction between flooring 14 and support 1. The ridges could be replaced with grooves or other surface configurations, or could even be eliminated. Other forms of physical variations in surfaces 22 and 24 are available. For example, to secure flooring 14 on the top section 17' of tack strip 17, carpet tacks or carpet pins 101 can be used.

Transition support 1 can be flexible sheet flooring prepared in roll form or in long sheets, with the thick and thin end portions being the side surfaces. The appropriate length is cut from the roll, or one or more sheets (or parts of sheets) are selected. The thickness of the thick end 16 should generally equal the difference in height between the two flooring areas. Adhesive is spread in the floor of the lower floor area as far from the juncture as support 1 will extend, on bottom surface 24 of support 1, or in the floor and the bottom surface, and the support 1 is laid in place. Adhesive is then put in top surface 22 of support 1 on the sheet flooring 14, or on both, and flooring 14 is then placed on support 1. The system is ready for use once the adhesive has dried or cured, if necessary.

Figure 5:
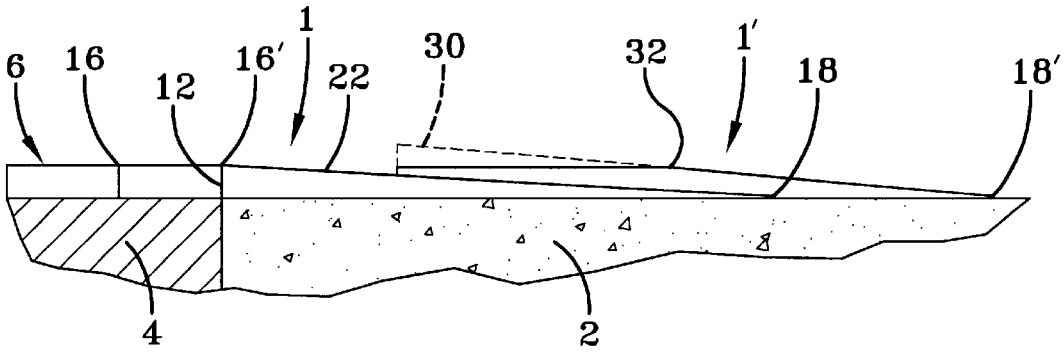
FIG. 5 is a side view of transition supports stacked in tandem.
Figure 6:
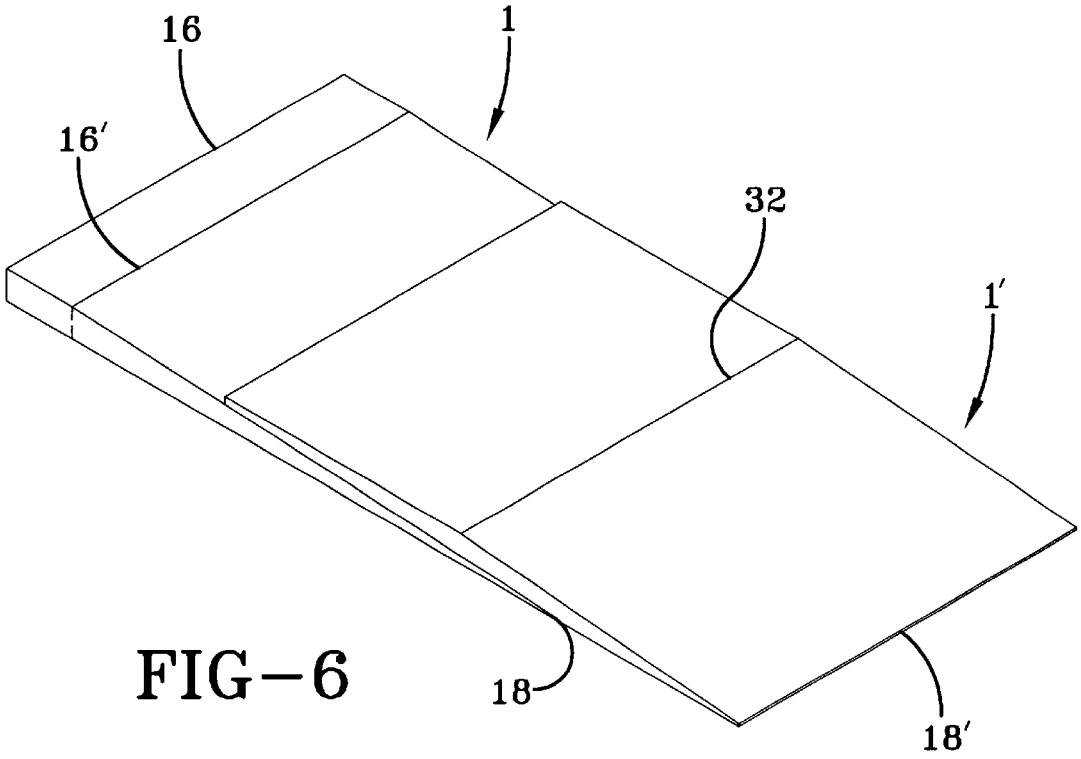
FIG. 6 is a perspective view of the stacked transition supports shown in FIG. 5.

In some situations, it may be necessary to decrease the slope of the tapered section of the transition support, as where the high floor requires a wider transition support. This can be accomplished by stacking transition support 1 in tandem, that is, by stacking them like shingles. Referring to FIG. 5, a transition support 1 is placed on floor 2 and attached by an appropriate adhesive. A second support 1' is adhered to support 1, but located on tapered section 22 of support 1, where it is glued in place. The thin end 18' of support 1' is located further from floor 4 than thin end 18 of support 1. The upper part 30, shown in dotted lines, is severed from support 1'. This can be accomplished by using a blade, cutting part way into support 1' at line 32, and then bending and severing part 30 from support 1'. The final product is shown in perspective in FIG. 6, in an embodiment without the ridges.

Transition support 1 is preferably made from vinyl (such as molded vinyl and extruded vinyl) or rubber composite so that it will have the desired flexibility and resilience. Harder materials may work in some situations, including polyethylene, polyester, recycled plastic, vinyl mixed with fillers such as limestone, vinyl composition and plastic-like materials.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

What is claimed is:

1. A transition support for extending over a low area of a floor and for extending under a flooring material where the floor has a high area at a relatively high height adjacent to the low area at a relatively low height, with a juncture between the high area and the low area, and a difference in the heights between the high area and the low area of the floor said transition support comprising an elongate wedge and a contiguous solid flat platform side wedge and said platform being in sheet form;

said wedge having a top surface and a bottom surface, and said wedge further including:

a relatively thick end having a thickness between the top surface and the bottom surface, the thickness being generally equal to said difference in the heights between the high area of the floor and the low area of the floor, said thick end being placeable at the juncture adjacent the high area of the floor;

a relatively thin end opposite said thick end and parallel to said thick end, said thin end being placeable on the low area of the floor remote from the high area of the floor and the juncture; and a tapering section forming the top surface of said wedge, said tapering section being support surface means for being covered with the flooring material, said wedge being means for rendering the junction generally unnoticeable to persons walking across the flooring material on said tapering section and for generally preventing the jostling of wheeled vehicles crossing the flooring material on said tapering section; and said contiguous flat platform including:

a flat extension of the thick end of said wedge, said flat section having the same thickness as the thickness of the thick end of said wedge;

said elongate wedge and said contiguous flat platform forming means for supporting persons and wheeled vehicles crossing said transition support.

2. A transition support according to claim 1 wherein the thickness of said thick end is at least ⅛ inches and the distance between said thick end and said thin end is at least 12 inches.

3. A transition support according to claim 1 wherein said support is selected from the group consisting of vinyl, polyester, recycled plastic, vinyl mixed with filler, and vinyl composition.

4. A transition support according to claim 1 wherein said support is selected from the group consisting of molded vinyl and extruded vinyl.

5. A transition support according to claim 1 wherein said tapering section interconnects the top surface of said thick end and the bottom surface at an interior angle of less than 10° measured at said thin end.

6. A transition support according to claim 5 wherein said interior angle is less then 5°.

7. A transition support according to claim 5 wherein said interior angle is 3°.

8. A transition support according to claim 1 wherein said tapering section has a surface with physical characteristics for retaining adhesives thereon for adhesively securing said support to the floor and for increasing the friction between said transition support and the floor said physical characteristics comprising at least one surface in said tapered section selected from the group consisting of ridges and, grooves.

9. A transition support according to claim 1 wherein said flat section has a smooth surface and the bottom surface of said wedge has physical characteristics for retaining adhesives thereon for adhesively securing said Support to the floor and for increasing the friction between said transition support and the floor said physical characteristics comprising at least one surface in said tapered section selected from the group consisting of ridges and, grooves.

10. A transition support according to claim 1 wherein said flat section has a smooth surface and said tapering section has a smooth surface.

11. A transition support for supporting flooring extending over a floor having an area at a relatively high height, an adjacent area at a relatively low height, a juncture between the relatively high area and the relatively low area, and a difference in the heights between the height of the high area of the floor and the height of the low area of the floor, said transition support comprising an elongated box and an elongated wedge in sheet form, and including:

a relatively thick end having an upper portion, a lower portion and a thickness between the upper portion and the lower portion, the thickness being generally equal to said difference in heights between the height of the high area of the floor and the height of the low area of the floor, said thick end being placeable in the juncture adjacent the high area of the floor;

a relatively thick strip opposite said thick end and parallel to said thick end, said thick strip having an upper portion, a lower portion and a thickness between the upper portion and the lower portion, the thickness being generally equal to the thickness of the thick end;

a relatively thin end opposite said thick end and parallel to said thick end, said thin end being placeable on the low area of the floor remote from the high area of the floor and the juncture;

a flat section having a support surface interconnecting the upper portion of said thick end and the upper portion of said thick strip, said flat section defining the elongated box for being covered with the flooring;

a carpet tack strip section having a top and a bottom, said top having carpet pins protruding therefrom and said bottom having at least one carpet nail protruding therefrom and connecting said carpet tack strip to said flat section; and a tapering section having a support surface interconnecting the upper portion of said thick strip and said thin end, said tapering section defining the wedge for being covered with the flooring, the distance between said thick strip and said thin end being at least 30 times the thickness of said thick end for rendering the junction generally unnoticeable to persons walking across said tapering section and for generally preventing the jostling of wheeled vehicles crossing said tapering section.

12. A transition support according to claim 11 wherein the thickness of said thick end is at least ¼ inches and the distance between said thick end and said thin end is at least 12 inches.

13. A transition support according to claim 11 wherein said support is selected from the group consisting of vinyl, polyester recycled plastic, vinyl mixed with filler and vinyl composition.

14. A transition support according to claim 11 wherein said support is selected from the group consisting of molded vinyl and extruded vinyl.

15. A transition support according to claim 11 wherein said tapering section interconnects the upper portion of said thick end and said thin end at an interior angle of less than 10° measured at said thin end.

16. A transition support according to claim 15 wherein said interior angle is less then 5°.

17. A transition support according to claim 15 wherein said interior angle is 3°.

18. A transition support according to claim 11 wherein said tapering section has a surface with physical characteristics for retaining adhesives thereon for adhesively securing said support to the floor and to the sheet flooring, and for increasing the friction between said transition support and the floor and the sheet flooring, said physical characteristics comprising at least one surface in said tapered section selected from the group consisting of ridges, grooves and physical variations.

19. A transition support according to claim 11 wherein said flat section has a smooth surface and said tapering section has a surface with physical characteristics for retaining adhesives thereon for adhesively securing said support to the floor and to the sheet flooring, and for increasing the friction between said transition support and the floor and the sheet flooring, said physical characteristics comprising at least one surface in said tapered section selected from the group consisting of ridges, grooves and physical variations.

20. A transition support according to claim 11 wherein said flat section has a smooth surface and said tapering section has a smooth surface.

21. A transition support according to claim 1 and further including a tack strip attached to said platform for attachment to flooring, material extending on said platform.

22. A transition support according to claim 1 wherein the distance between the thick end of said wedge and the thin end of said wedge is at least 30 times the thickness of said thick end.

23. A transition support according to claim 1 wherein said support is made from a hard material.

24. A transition support according to claim 1 wherein said support is made from a flexible material which can be stored in a roll.

25. A transition support for extending over a low area of a floor and for extending under a flooring material where the floor has a high area at a relatively high height adjacent to the low area at a relatively low height, with a juncture between the high area and the low area, and a difference in the heights between the high area and the low area of the floor, said transition support comprising an elongate wedge and a contiguous solid flat platform said wedge and said platform being in sheet form;

said wedge having a top surface and a bottom surface, and said wedge further including:

a relatively thick end having a thickness between the top surface and the bottom surface, the thickness being generally equal to said difference in the height between the high area of the floor, and the low area of the floor, and the thickness of the flooring material, said thick end being placeable at the juncture adjacent the high area of the floor, the flooring material being placeable on said support to be generally flush with the upper surface of the high area of the floor;

a relatively thin end opposite said thick end and parallel to said thick end, said thin end being placeable on the low area of the floor remote from the high area of the floor and the juncture; and a tapering section forming the top surface of said wedge, said tapering section being a support surface means for being covered with the flooring material, the distance between said thick end and said thin end being at least 30 times the thickness of said thick end said wedge being means for rendering the junction generally unnoticeable to persons walking across said tapering section and for generally preventing the jostling of wheeled vehicles crossing the flooring material on said tapering section; and said contiguous platform including:

a flat extension of the thick end of said wedge, said flat section having the same god thickness as the thickness of the thick end of said wedge;

said elongate wedge and said contiguous flat platform forming means for supporting persons and wheeled vehicles crossing said transition support.

26. A transition support according to claim 25 wherein the thickness of said thick end is at least ⅛ inch and the distance between said thick end and said thin end is at least 12 inches.

27. A transition support according to claim 25 wherein said support is selected from the group consisting of vinyl, polyester, recycled plastic, vinyl mixed with filler and vinyl composition.

28. A transition support according to claim 25 wherein said support is selected from the group consisting of molded vinyl and extruded vinyl.

29. A transition support according to claim 25 wherein said tapering section interconnects said thick end and said thin end at an interior angle of less than 10° measured at said thin end.

30. A transition support according to claim 25 wherein said interior angle is less than 5°.

31. A transition support according to claim 25 wherein said interior angle is 3°.

32. A transition support according to claim 25 wherein said tapering section has a surface with physical characteristics for retaining adhesives thereon for adhesively securing said support to the floor and to the flooring material, and for increasing the friction between said transition support and the floor and the flooring material.

33. A transition support according to claim 25 wherein said support is made from a hard material.

34. A transition support according to claim 25 wherein said support is made from flexible material which can be stored in a roll.

35. A transition support for extending over a low area of a floor and for extending under a flooring material where the floor has a high area at a relatively high height adjacent to the low area at a relatively low height, with a juncture between the high area and the low area, and a difference in the heights between the high area and the low area of the floor, said transition support comprising an elongate wedge and a contiguous solid flat platform;

said wedge and said platform being in sheet form, said wedge having a top surface and a bottom surface, and said wedge further including:

a relatively thick end having a thickness between the top surface and the bottom surface, the thickness being generally equal to a desired height relative to the height of the high area of the floor for being placeable at the juncture adjacent the high area of the floor with the upper surface of the flooring material on said transition support being generally flush with the top surface on the high area;

a relatively thin end opposite said thick end and parallel to said thick end, said thin end being placeable on the low area of the floor remote from the high area of the floor and the juncture; and a tapering section forming the top surface of said wedge, said tapering section being means for being covered with the flooring material, the distance between said thick end and said thin end being at least 30 times the thickness of said thick end, said wedge being means for rendering the junction generally unnoticeable to persons walking across the flooring material on said tapering section and for generally preventing the jostling of wheeled vehicles crossing the flooring material on said tapering section; and said contiguous platform including:

a flat extension of the thick end of said wedge, said flat section having the same thickness as the thickness of the thick end of said wedge;

said elongate wedge and said contiguous flat platform forming means for supporting persons and wheeled vehicles crossing said transition support.

* * * * *